US005305966A

United States Patent [19]

Motta

[11] Patent Number: 5,305,966

[45] Date of Patent: Apr. 26, 1994

[54] DEVICE FOR THE DIFFERENTIAL BRAKING OF TRAVELING THREADS, WIRES OR THE LIKE

[75] Inventor: Bruno Motta, Pregassona, Switzerland

[73] Assignee: Sobrevin Société de brevets industriels-Etablissement, Vaduz, Liechtenstein

[21] Appl. No.: 903,513

[22] Filed: Jun. 24, 1992

[30] Foreign Application Priority Data

Jul. 22, 1991 [DE] Fed. Rep. of Germany ... 9109001[U]
Oct. 29, 1991 [DE] Fed. Rep. of Germany ... 9113430[U]

[51] Int. Cl.[5] ..... B65H 59/22
[52] U.S. Cl. ..... 242/149; 139/450
[58] Field of Search ..... 242/149, 150 R, 150 M, 242/147 R, 147 M; 139/450

[56] References Cited

U.S. PATENT DOCUMENTS

| | | | |
|---|---|---|---|
| 2,537,476 | 1/1951 | Moessinger | 242/149 |
| 3,340,903 | 9/1967 | Golobart | 242/149 X |
| 3,348,582 | 10/1967 | Brookshire | 242/149 X |
| 3,633,711 | 1/1972 | Pfarrwaller | 242/149 X |
| 3,797,426 | 3/1974 | Von Hagen | 242/150 M X |
| 4,378,096 | 3/1983 | Schnegg | 242/149 |
| 4,641,688 | 2/1987 | Gehring | 242/149 X |
| 5,002,098 | 3/1991 | Desmet et al. | 139/450 X |
| 5,179,980 | 1/1993 | Hubner et al. | 242/149 X |

FOREIGN PATENT DOCUMENTS

| | | |
|---|---|---|
| 0384502 | 8/1990 | European Pat. Off. . |
| 3446567 | 5/1986 | Fed. Rep. of Germany . |
| 2375366 | 7/1978 | France . |
| 2196994 | 5/1988 | United Kingdom . |

*Primary Examiner*—Stanley N. Gilreath
*Attorney, Agent, or Firm*—Martin A. Farber

[57] ABSTRACT

A device for braking traveling threads, wires or the like, in particular for use for the entry of the filling thread in looms (8), having a plurality of brake parts (B, B') which are under spring action with respect to each other and between which the thread (5) travels; in order to obtain optimal use, a cyclic change in the brake force is derived from the rotation by motor drive of one of the brake parts (B, B', C, C').

8 Claims, 7 Drawing Sheets

Fig: 6
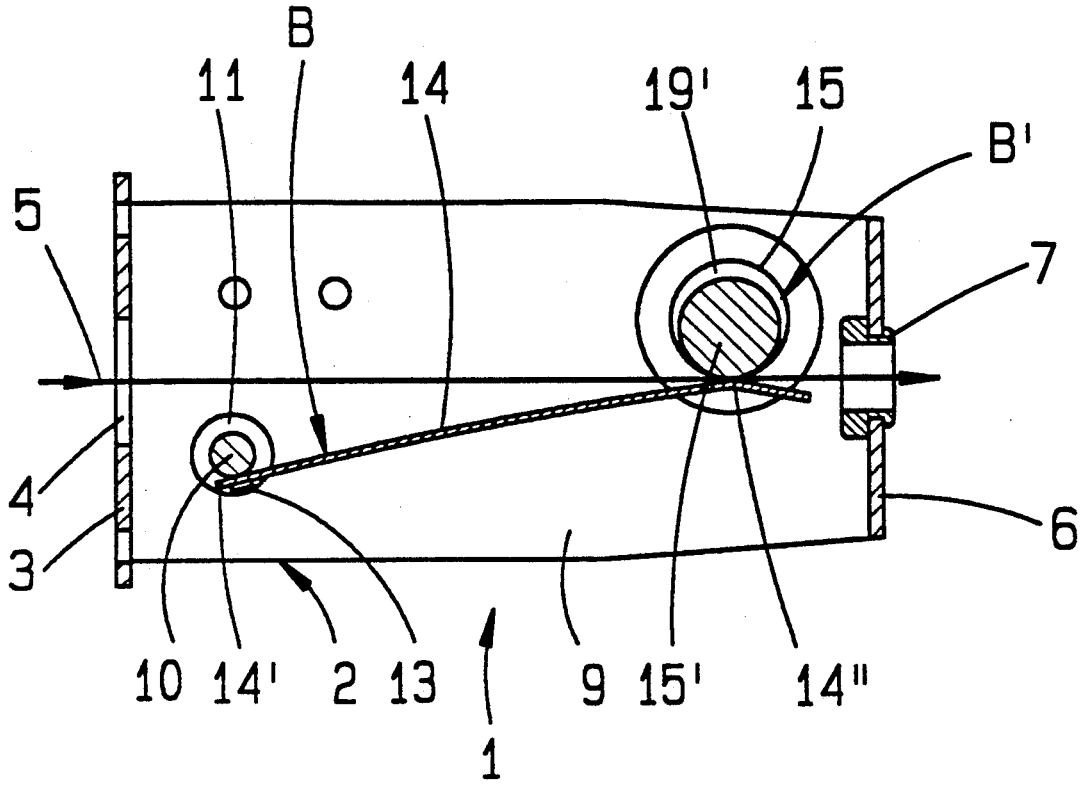
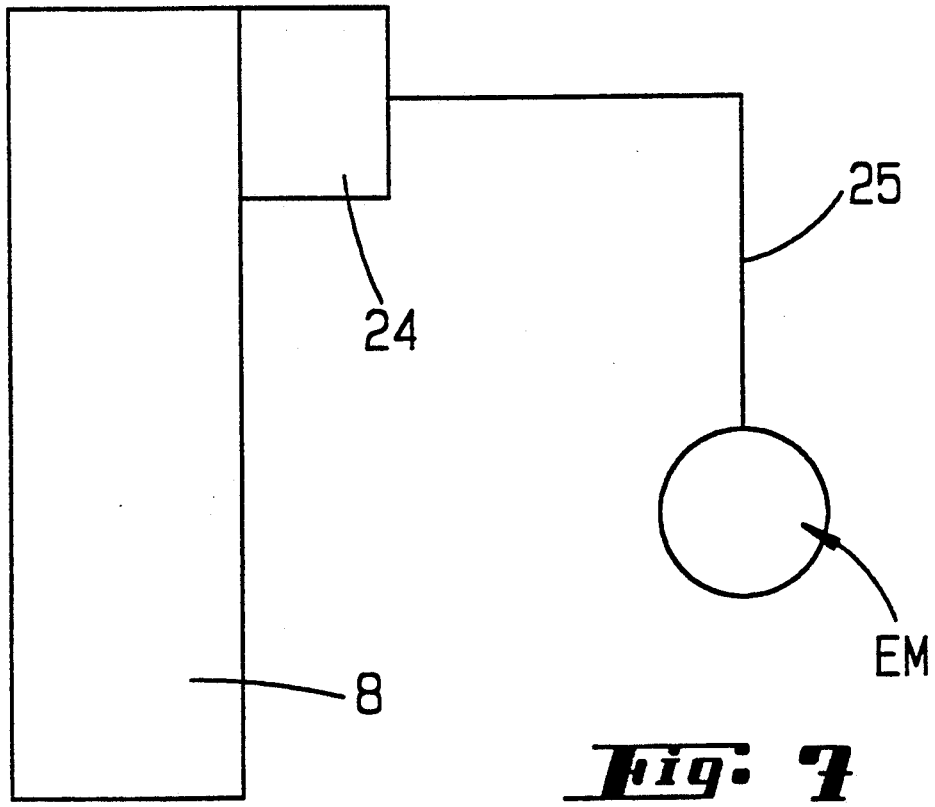
Fig: 7

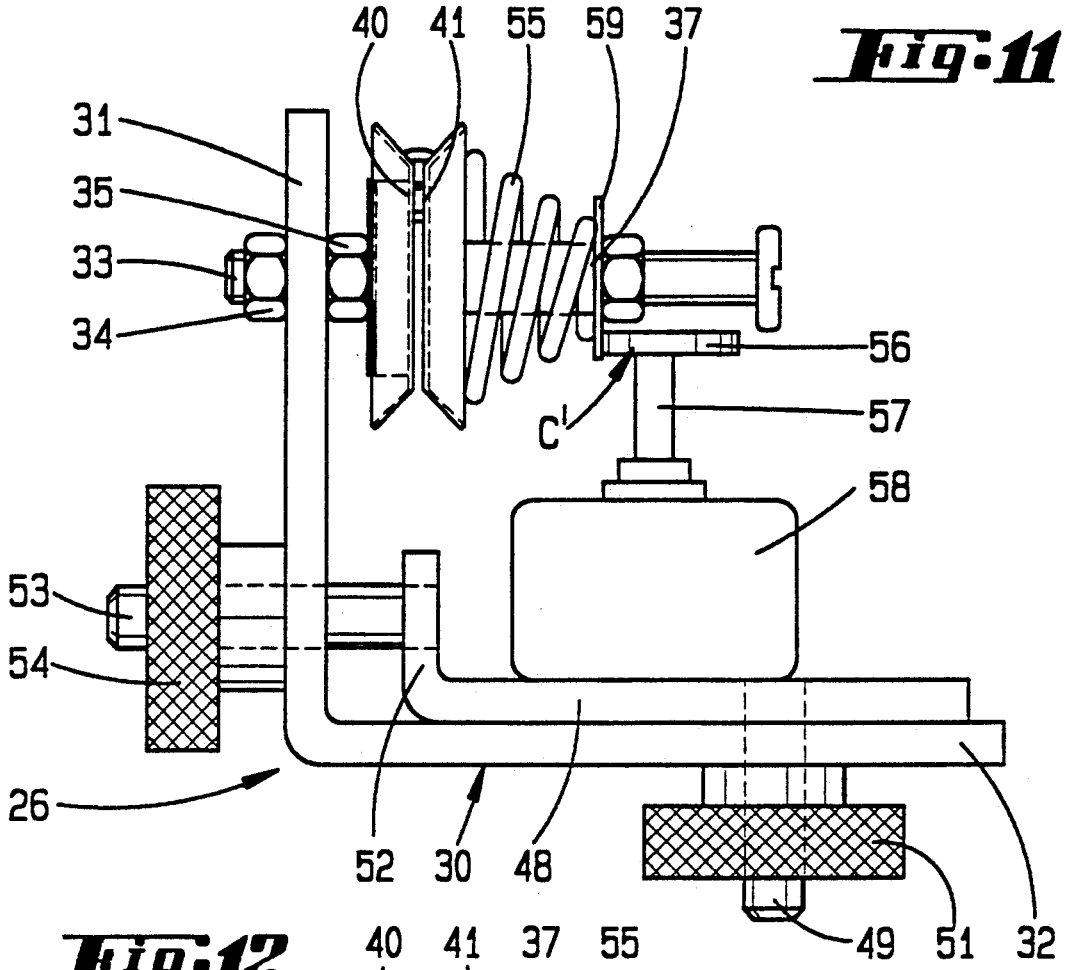
Fig. 11
Fig. 12
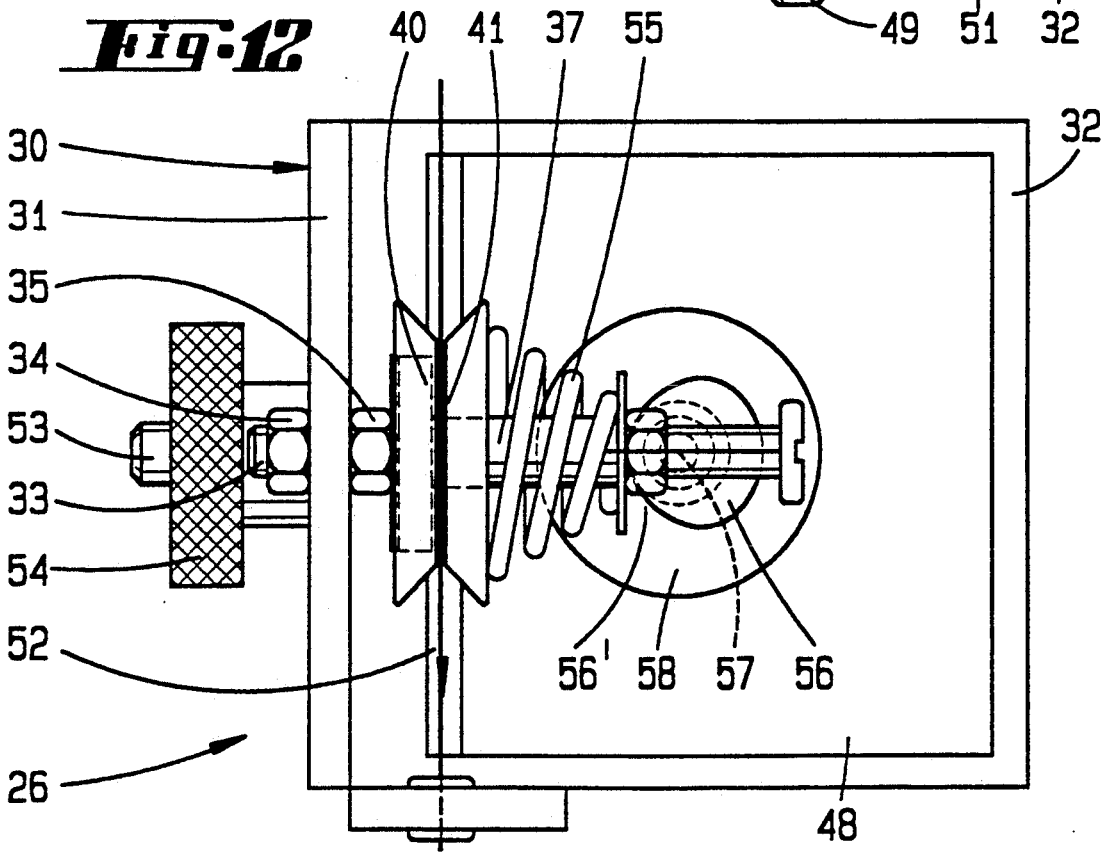

DEVICE FOR THE DIFFERENTIAL BRAKING OF TRAVELING THREADS, WIRES OR THE LIKE

FIELD AND BACKGROUND OF THE INVENTION

The present invention relates to a device for the differential braking of traveling threads, wires or the like, particularly for use in connection with the filling thread insertion on looms, having two or more braking parts under spring action with respect to each other between which the thread passes.

Devices are known on the market in which the brake parts, which are under spring action with respect to each other, have two or more plates consisting of spring material between which the thread travels. The spring force with which the two plates come against each other must, on the one hand, be sufficiently great to produce sufficient braking of the thread. On the other hand, they must not impair the insertion of the filling. It must also be taken into account that knots must be able to pass through the plates which are under spring action with respect to each other without the thread being broken. In present-day looms, which operate with high weft speed with cyclic insertion of the filling taking place at short time intervals, only a few milliseconds are present due to the start and stop principle for the braking and release of the thread, with the problem that the plates, which are under spring action with respect to each other, do not react sufficiently rapidly and lead to disturbances in the transport of the thread.

SUMMARY OF THE INVENTION

The object of the invention is accordingly so to develop a device of the type in question in a manner simple to construct that, in addition, on the one hand, to a particularly rapidly responding manner of operation, sufficient braking force is always present while, on the other hand, the passage of the thread is not impaired even with the highest speeds of the filling thread and with cyclic entry of the filling thread in the loom at short time intervals.

As a result of the invention, the utilitarian value of the type in question is considerably increased. The device can be optimally adjusted to the manner of operation of the loom even when operating with the highest speeds of the filling thread with cyclic pick occurring at short intervals. Nevertheless, there is always sufficient braking force of the brake parts passed through by the thread. During the pick the braking force is practically zero, due to the rotation by motor of one of the brake parts. The thread can, accordingly, pass through the device without disturbance, even if knots are present on the thread. After the completion of the pick, the brake parts return into braking position with respect to each other as a result of the rotation of the corresponding motor-driven brake part. The thread is therefore optimally protected upon passage through the device, which in the final analysis results in a particularly good quality of weave.

In accordance with the invention one brake part is a shaft driven in rotation by a motor and acted on by a plate resting resiliently against it, said shaft having a cross-section-reducing window on a part of its circumference. During the pick, the motor-driven shaft assumes such a position that the thread passes through the cross-section-reducing window. After the completion of the pick the shaft turns into a position in which the cross-section-reducing window lies outside the path of passage of the thread. The thread is then pressed by the resiliently applied plate against the circumference of the shaft.

It was then found advantageous for annular collars of circular cross section to be provided as a supporting surface for the resilient plate axially on both sides of the window. The plate can therefore rest with unchanged force against the shaft, even when the window is opposite the plate. This is the position in which the thread can pass unimpeded through both brake parts.

Another advantage resides in the fact that the bearing-side end section of the freely extending shaft is developed as a rotor of an electromagnetic rotary drive fixed in place. This drive can be favorably adapted to the manner of operation of the loom. In this way, assurance is had that the thread can pass through the window of the shaft at the correct moment upon the insertion of the filling. The electromagnetic rotary drive permits very short control times.

The electrical coupling of the rotary drive to the control of the loom has the result that the electromagnetically driven shaft always assumes its intended position at the proper moment.

One version is characterized by the fact that the window is formed by a cross-sectional reduction which extends over about 90° of the circumference and has a convexly shaped bottom with linear transition into the circumferential surface.

In another embodiment, the window is developed by an eccentric arrangement of a circular section of smaller diameter.

The braking force with which the plate rests against the shaft can easily be adjusted in the manner that the plate projects on a freely extending mandrel which is rotatable in a friction-held support for adjusting the spring application between plate and shaft.

The faster the storage drum or the thread eye of the thread-delivery device rotates, the less the spring force and thus the braking action on the thread. On the other hand, the braking force becomes greater when the storage drum or thread eye rotates slowly or stops.

In an alternative development, cup disks between which the thread travels and which are acted on by a compression spring, are arranged on a common shaft, the compression spring acting on a motor-driven brake part which changes its tension. The compression spring is loaded and unloaded cyclically by the brake part as a function of the manner of operation of a thread-delivery device or of the loom arranged behind it. There can thus be no endangering peak stresses on the passing thread, with optimal protection of the thread, as a result of which a favorable influence is exerted on the quality of the weave. This means that, as the need for thread becomes greater, the brake part moves away from the compression spring, hand in hand with a reduced braking force between the cup disks.

One suitable structural shape is characterized by the fact that the shaft has an external thread, turnable on it, with a nut which forms the brake part, the circumferential toothing of the nut meshing with a motor-driven pinion. The rotary drive which drives the pinion is in this connection reversible as to direction of rotation, permitting a backward and forward movement of the nut which travels on the outer thread of the shaft. Hand in hand with the forward and backward movement, the spring force acting on the cup disks is cyclically changed in accordance with the manner of operation of the thread-delivery device or the loom.

In order that, despite the backward and forward movement of the nut, the latter remains in engagement with the pinion, the length of the pinion is greater than the length of the nut.

Presetting of the braking force can be effected in simple fashion in the manner that the rotary drive with pinion is arranged on a carriage which is movable and adjustable relative to the cup disks.

Finally, one advantageous embodiment also resides in the brake part being developed as eccentric disk of a rotary drive developed as a electric motor. The motor shaft with eccentric disk can therefore always rotate in one direction. The speed of rotation is adapted in this connection to the manner of operation of the loom, while maintaining synchronism between the insertion of the filling thread and the speed of rotation.

BRIEF DESCRIPTION OF THE DRAWINGS

Three embodiments of the invention will be explained below with reference to the drawings, in which:

FIG. 6 is a horizontal section through a modified device shown in the thread-clamping position;

FIG. 7 is a block diagram showing the electrical coupling of the rotary drive with the control of the loom;

FIG. 11 is a longitudinal section through the device in accordance with a third embodiment, and FIG. 12 is a top view of this device.

DETAILED DESCRIPTION OF THE PREFERRED EMBODIMENTS

Figure 1:
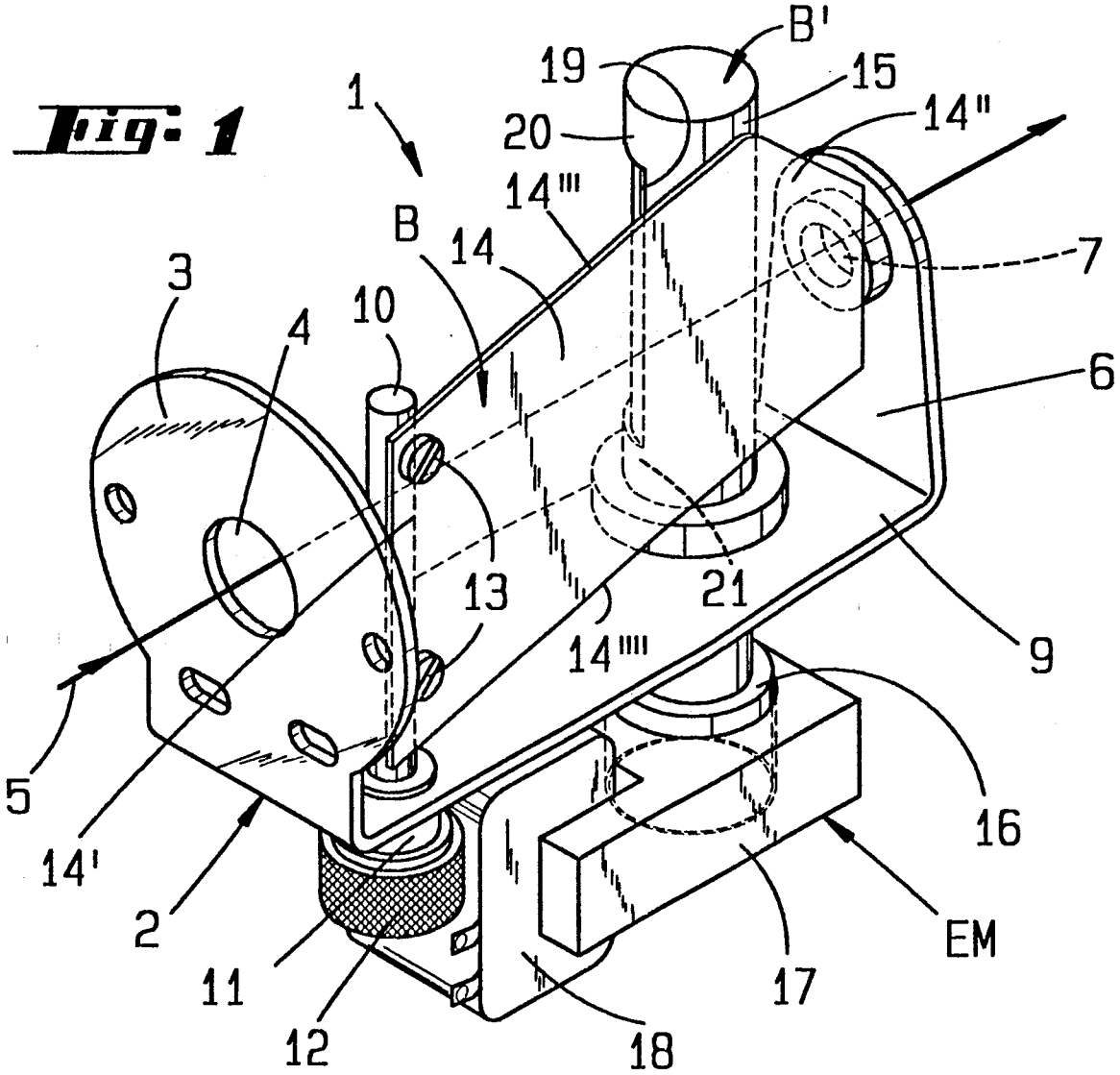
FIG. 1 is a perspective view of the device of the invention.

The device in accordance with the first embodiment is designated generally by the numeral 1 and has a U-shaped support frame 2. In one upward-extending U-arm 3 there is an entrance opening 4 for a thread 5. Aligned with the entrance opening 4, a thread-removal eye 7 is provided on the other U-arm 6 of the frame 2.

A thread-delivery device (not shown) is preferably arranged behind the device. After passing through the device 1, the thread then arrives at a loom 8.

The web 9 of the U-shaped supporting frame 2 receives a free-standing mandrel 10 near the U-arm 3 provided with the entrance opening 4. The upward-directed free end of said mandrel extends slightly above the U-arm 3. The lower end of the mandrel 10 is seated in friction-locked manner in a bearing 11 which is fastened on the U-web 9. The lower end of the mandrel 10 passing through said bearing is provided with a turn knob 12 by which the mandrel 10 can be turned while overcoming the bearing friction.

Above the web 9, one end 14' of a plate 14 consisting of spring material is connected by screws 13 to the mandrel 10. As an alternative, the mandrel 10 could also be slit longitudinally in order to hold the end 14' of the plate 14. The other end 14'' of the plate rests against a motor-driven shaft 15 which extends parallel to the mandrel 10, close to the U-arm 6. The plate 14 which is urged in the direction towards the shaft 15 and the shaft 15 constitute two brake parts B, B' between which the thread 5 travels. Both the mandrel 10 and the shaft 15 are so arranged that they do not lie disturbingly within the passageway of the thread 5 and permit the central passage of the thread through the entrance opening 4 and the thread-removal eye 7.

The end 14'' lying on the other side of the linear engagement against the shaft 15 is bent in direction away from the direction of passage of the thread.

Both the free end of the shaft 15 and the free end of the mandrel 10 extend above the upper longitudinal flank 14''' of the plate 14. The opposite longitudinal flank 14'''', of the plate extends just above the web 9 of the U-shaped support frame 2. The shaft 15 passes through the web 9 and, at its lower end, bears a permanent magnet 16 of circular cross section representing a rotor which, in its turn, is rotatably associated with an electromagnet 17. Its winding bears the reference numeral 18. In this way, an electromagnetic rotary drive EM is created for the shaft 15, by means of which it is possible to turn the shaft 14 within the range of about 90° to 180°.

In accordance with the embodiment shown in the drawing, the shaft 15 turns in each case by 180°. The shaft 15, which is motor-driven in rotation, is provided on a part of its circumference with a cross-section-reducing window 19. Axially on both sides of the window 19, the shaft 15 forms annular collars 20, 21 of circular cross section which serve as engagement surfaces for the spring plate 14. In accordance with FIGS. 1 to 5, the window 19 is formed by a reduction in cross section of the shaft 15 which extends over about 90° of the circumference, with a convexly shaped bottom 22 with linear transition 23 into the circumferential surface of the shaft 15.

The loom 8 is provided with a control 24, shown in block diagram in FIG. 7, by which the pick is controlled. The control 24 is, in its turn, connected via an electric coupling 25 to the electromagnetic rotary drive EM, which, in accordance with the embodiment shown, permits a timed rotary drive of the shaft 15.

The force with which the spring plate 14 rests against the shaft 15 can be varied by turning the rotary knob 12, overcoming the friction-locked mounting of the mandrel 10. The friction held mounting of the mandrel 10 can, in this connection, not be overcome by the plate 14. The presetting permits adaptation to different thread entry angles. It would also be possible to mount the shaft displacably and displace the shaft itself, preferably in the direction towards the spring plate 14 or away from it.

Figure 2:
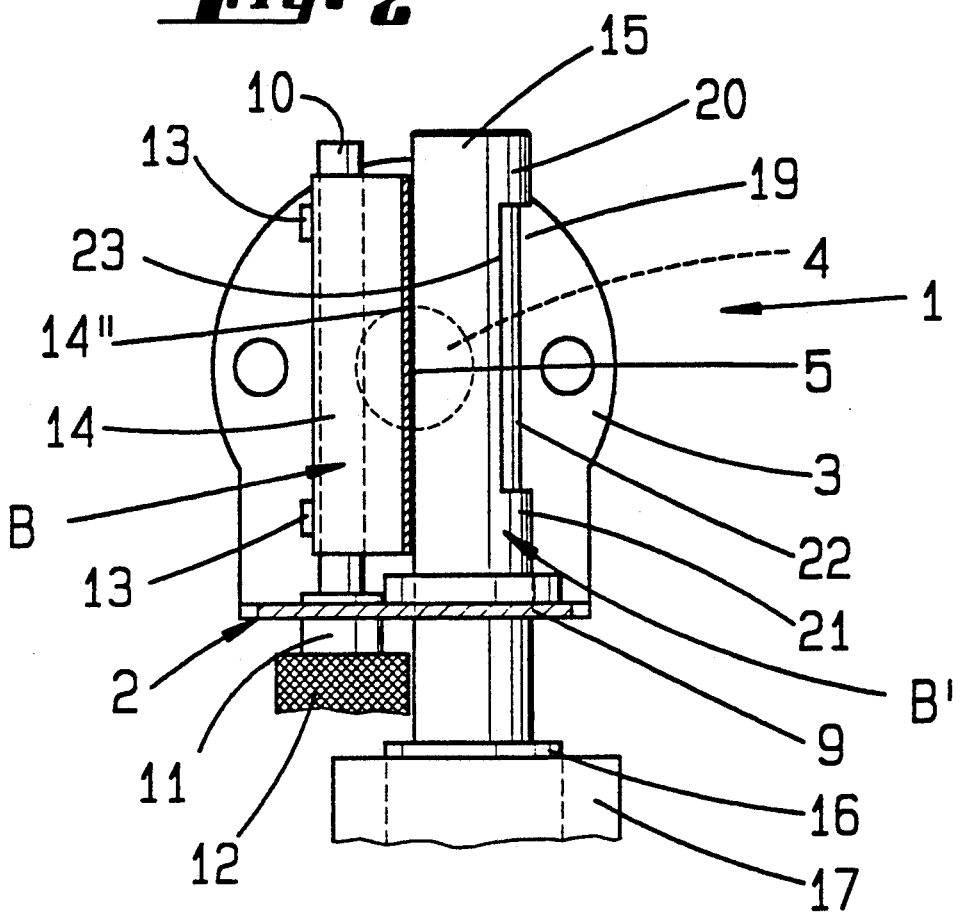
FIG. 2 is a longitudinal section through the shaft in its thread-clamping position.
Figure 3:
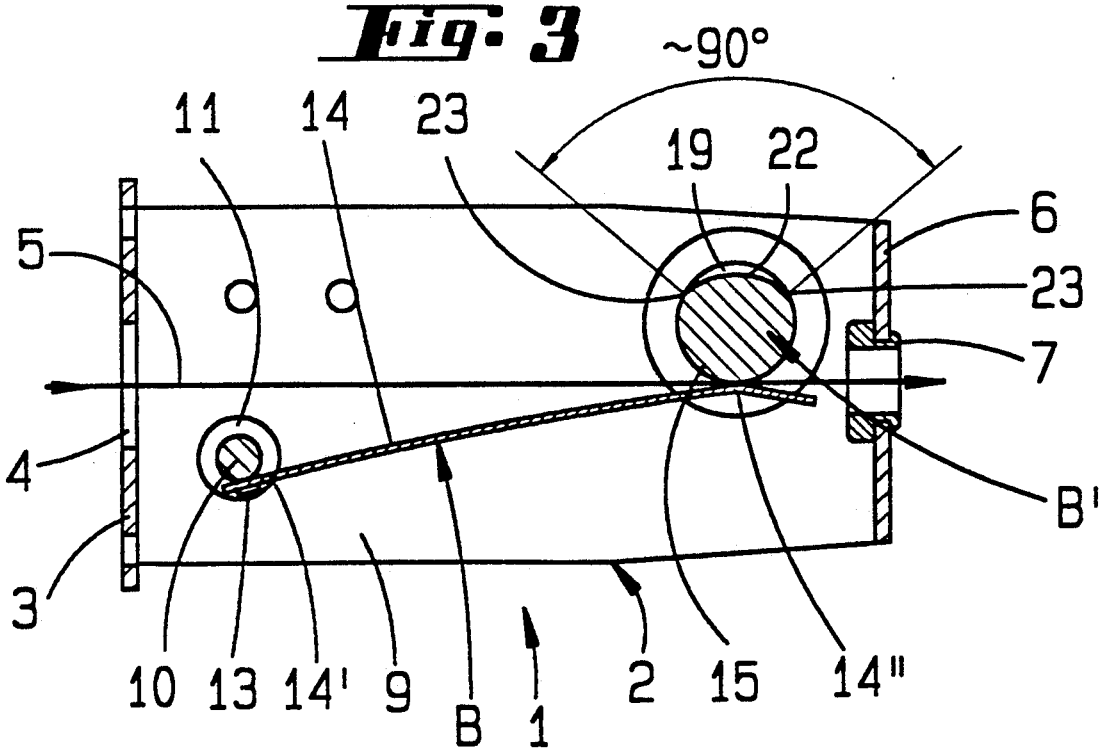
FIG. 3 is a horizontal section through the device also showing the thread-clamping position.

The manner of operation of the device is as follows:

The thread-clamping position can be noted from FIGS. 1 to 3. The shaft 15 assumes a position in which the window 19 is shifted about 180° with respect to the thread-passage place. The end 14'' lies, spring-loaded, against the shaft 15, producing a practically linear contact resulting in a braked passage of the thread 5.

Figure 4:
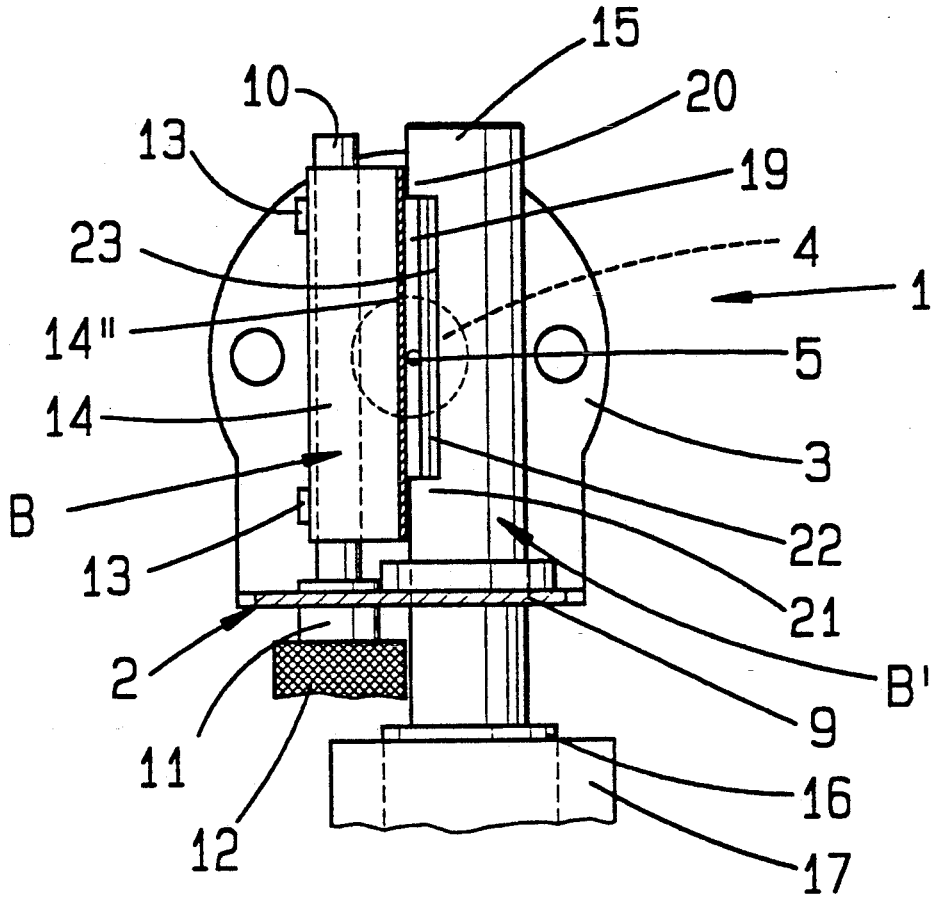
FIG. 4 is a view corresponding to FIG. 2, but in the thread-release position.
Figure 5:
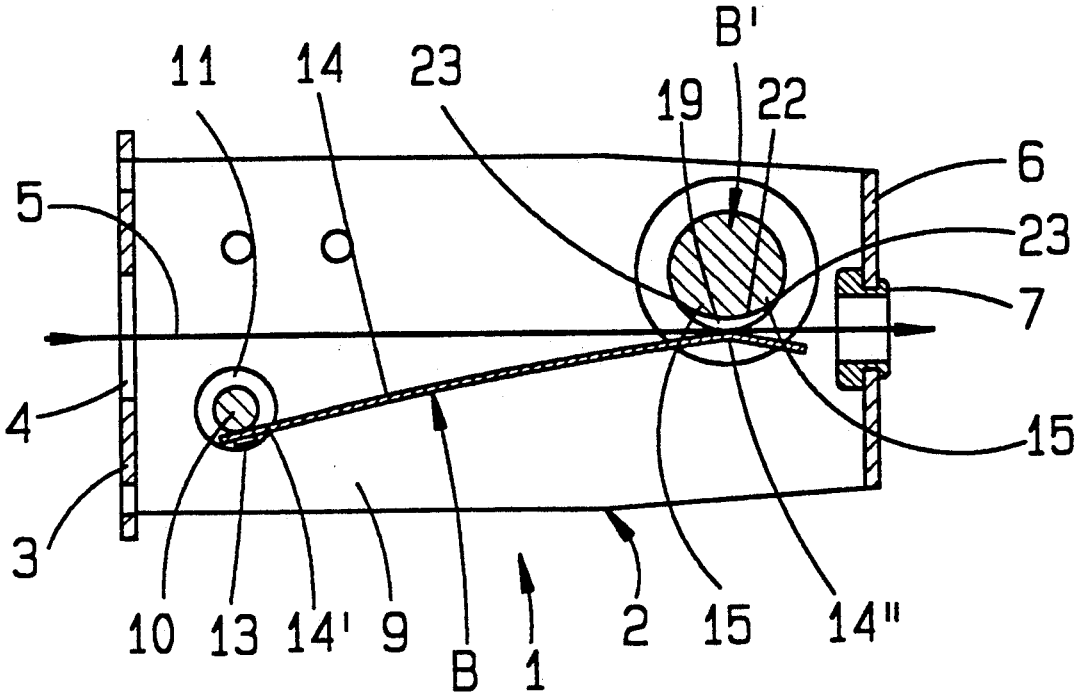
FIG. 5 is a horizontal section through the device, the thread being in the release position.

If a command to enter a filling thread is given via the control 24 of the loom 8, then the electromagnetic rotary drive EM is simultaneously imparted via the coupling 25, the signal to turn the shaft 15 by 180° into the position shown in FIGS. 4 and 5. As a result hereof, the window 19 comes opposite the end 14" of the plate 14, which then rests against the annular collars 20, 21 of the shaft. There is thus a free passage for the thread 5. Upon the pick, the filling thread can pass through the device 1 without being impaired by braking force. After the entrance of the filling thread, the control 24 gives the loom 8 the command to turn the shaft 15 via the electromagnetic rotary drive EM by 180° into the position shown in FIGS. 1 to 3. This rotation is preferably effected in such a manner that the direction of rotation corresponds to with the direction of passage of the thread, so that an accumulation in front of the shaft 15 is definitely prevented. A cyclic change in the braking force from the rotation by the motor of one of the brake parts B,B' therefore takes place, namely the brake part B' representing the shaft 15.

In the thread-release position shown in FIGS. 4 and 5, the convex bottom 22 of the window permits optimal passage of the thread even if knots are present on it, since an entrance funnel is, so to speak, formed in the entrance region in front of the window.

Instead of a cyclic rotary drive of the shaft 15, continuous rotation of the shaft 15 by means of an electric motor would also be possible, in which case the synchronism between entry of the filling thread and speed of rotation would have to be produced.

FIG. 6 shows a different development of the window 19'. The latter is now formed by an eccentric arrangement of a circular section 15' of smaller diameter, in the manner that the wall of the circular section 15' opposite the window 19 is aligned with the wall of the shaft 15. In this way, a window 19' of crescent shape is created. FIG. 6 shows the thread-clamping position in this case. The window 19' passes into the thread-release position by an approximately 180° rotation of the shaft 15. The manner of operation of this modified device of FIG. 6 corresponds to the device described above.

Figure 8:
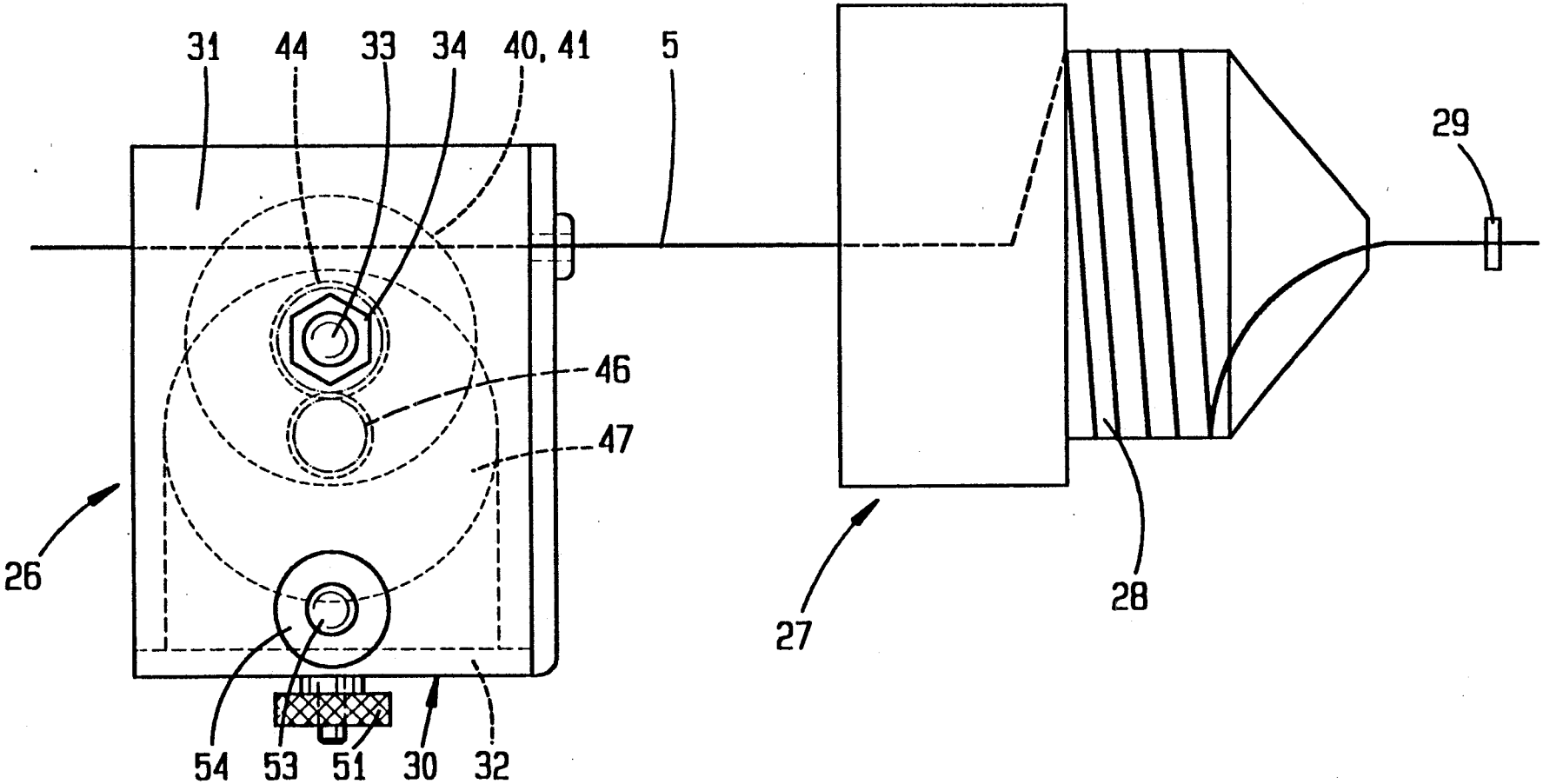
FIG. 8 shows diagrammatically a second embodiment of the device, arranged in front of a thread-delivery device.
Figure 9:
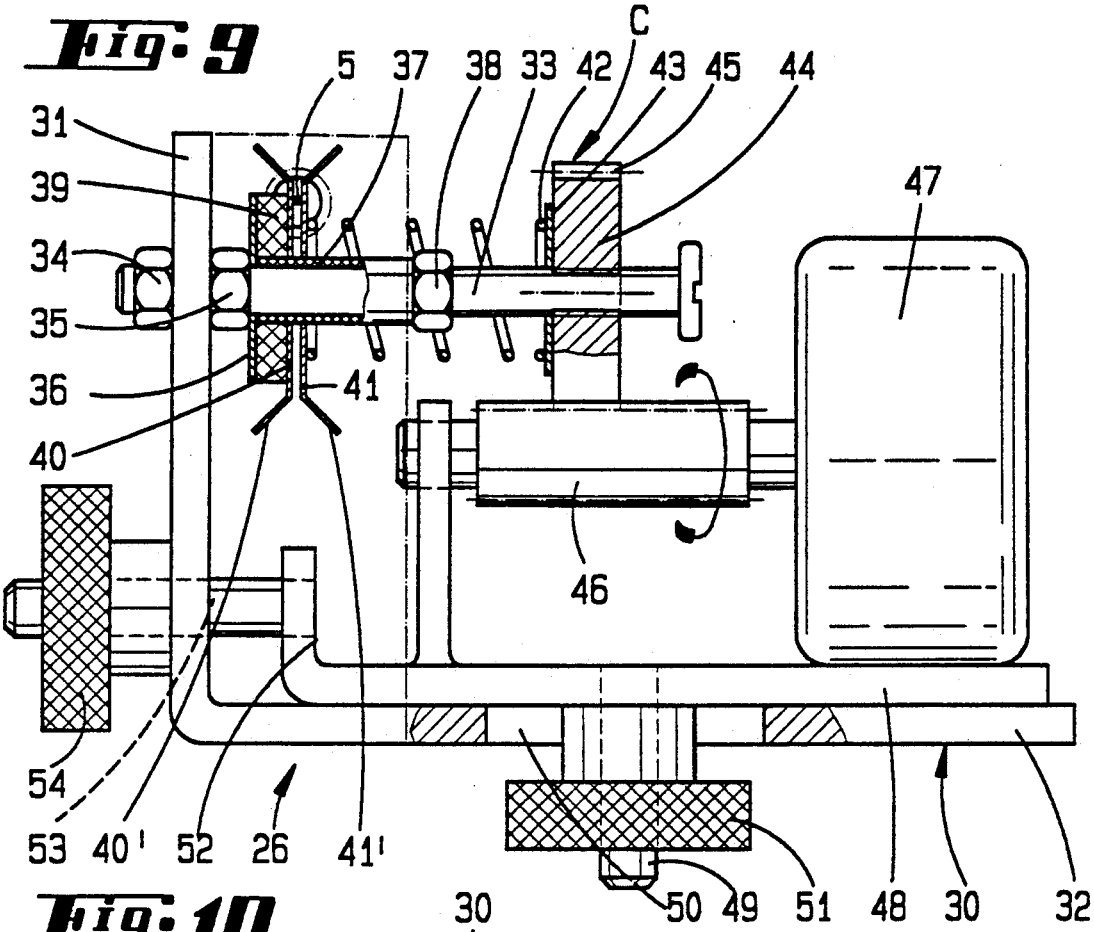
FIG. 9 is a longitudinal section through the device.
Figure 10:
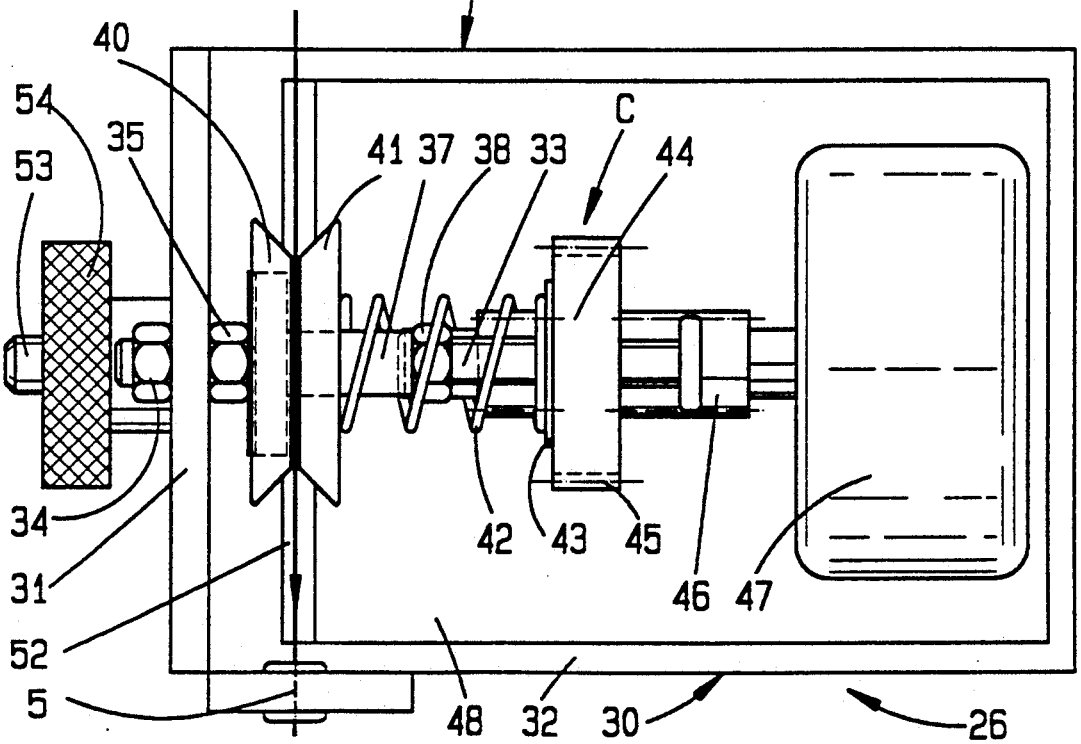
FIG. 10 is a top view of the device.

In accordance with the second embodiment, shown in FIGS. 8 to 10, a device 26 of modified development is arranged in front of a thread-delivery device 27. The latter has a storage drum 28 on which the thread 5 is applied from a rotating thread eye (not shown). The thread 5 leaves the storage drum 28 through the delivery eye 29 and passes from there to a loom (not shown). By the thread-delivery device 27 the result is obtained that there is always a sufficient supply of thread for the pick. This means that the manner of operation of the delivery device is adapted to that of the loom. This is also true of the device 26.

In detail, the device 26 has a support angle 30. Its vertically directed angle arm 31 supports a shaft 33 parallel to the horizontal angle arm 32. This shaft is provided with an external thread and held fast by nuts 34, 35 on the angle arm 31. A disk 36 rests against the nut 30 present on the inside of the angle. The disk 36 is held in its position by a sleeve 37 arranged on the shaft 33 as well as a clamping nut 38. There furthermore rests against the disk 36 a ring 39 consisting of flexible material. Felt is selected as material for the ring 39. Two disks between which the thread 5 passes are then arranged on the sleeve 37. These disks are cup disks 40 and 41. The cup disks 40, 41 are so arranged on the sleeve 37 that the cup edges 40', 41' extend in opposite directions, forming a funnel for the introduction of the thread 5.

The bottoms of the cup disks 40, 41 which come against each other are flat. The one end of a compression spring 42 which surrounds the sleeve 37 and shaft 33 comes against the bottom of the cup disk 41, while the other end of said spring rests, with the interposition of a disk 43, against a nut 44 which forms a rotatable brake part C. Said nut is arranged for displacement on the external thread of the shaft 33. The nut 44 is, furthermore, provided with a circumferential toothing 45 which meshes with a motor-driven pinion 46. From FIG. 9 it can, in particular, be seen that the length of the pinion 46 is greater than the length of the nut 44. The pinion 46 is placed in rotation by a rotary drive 47 which is developed as an electric motor of reversible direction of rotation.

The rotary drive 47, together with the pinion 46, is received by a carriage 48. On the bottom of the latter there is fastened a threaded pin 49 which passes through a slot 50 in the horizontal angle arm 32. A clamping nut 51 is screwed onto the portion of the threaded pin 49 which protrudes above said arm in order to secure the corresponding position of the carriage.

The end of the carriage 48 which faces the vertical angle arm 31 forms a bend 52. This bend bears a threaded pin 53 which extends parallel to the horizontal angle arm 32 and has an adjustment nut 54 which rests against the outer flank of the vertical angle arm 31. After the loosening of the clamping nut 51, the spring force of the compression spring 42 can be preadjusted by displacing the carriage 48 by means of the adjustment nut 54.

The manner of operation with this device is as follows:

The thread 5 passes through the device 26 in the region between the two cup disks 40, 41.

If a coupling (not shown) between rotary drive 47 and the thread-delivery device 27 indicates that the storage drum or the thread eye is rotating faster, then the pinion 46 is driven in the direction of rotation by the rotary drive 47 so that the nut 44 moves in direction opposite the cup disks 40, 41, with reduction of the spring force acting on the cup disks 40, 41.

When the storage drum 28 of the thread-delivery device 27 is again full, the direction of rotation of the electric motor 47 is switched. Hand in hand with this, the nut 44 moves in the direction of the cup disks 40, 41, tensioning the compression spring 42 and increasing the braking force acting on the thread 5.

The above processes take place in cyclic sequence and are adapted to the manner of operation of the thread-delivery device 27 and that of the loom.

As an alternative, it would be possible to drive the shaft 33 directly by the rotary drive 47, in which case an anti-turn lock for the nut 44 would have to be provided. In such case, a pinion 46 could be dispensed with as transmission element.

The third embodiment, shown in FIGS. 11 and 12, corresponds extensively to the third embodiment which has been described above. Identical structural parts bear the same reference numbers. As brake part C' which acts on the compression spring 55 there is now employed an eccentric disk 56 which is fixed in non-turnable manner on the drive shaft 57 of a rotary drive 58. The rotary drive is an electric motor with drive shaft 57 traveling in one direction of rotation. The center axis of the drive shaft 57 intersects that of the shaft 33.

With the interpositioning of an annular disk 59 which is displaceable on the sleeve 37, the eccentric 56 acts on the compression spring 55. The compression spring 55 is a conical spring the turn of which of larger diameter rests against the cup disk 41. Upon rotation of the drive shaft 57 and thus of the eccentric 56, the compression spring 55 is tensioned and relaxed together with a change in the braking force acting on the cup disks 40, 41. In detail, upon the resting of the compression spring 55 against the roof-shaped vertex 56' of the eccentric 56, the compression spring 55 is relaxed. Upon further rotation of the eccentric 56, the tension of the compression spring 55 is then increased, increasing the braking force acting on the thread 5. There is thus also a cyclic change in the braking force. Furthermore, the speed of rotation of the rotary drive 58 is adapted to the manner of operation of the thread-delivery device 27 in such a way that the braking and release always take place at the correct time upon the passage of the thread

I claim:

1. A device for differential braking of traveling elongated, flexible material including threads, wires and the like, particularly for use upon entry of filling thread in a loom, comprising brake parts which are arranged with spring action with respect to each other and between which the material travels, one of said brake parts comprising a rotatable shaft, a motor for driving said shaft in rotation, another of said brake parts comprising a plate which resiliently abuts said shaft, and said shaft having a window formed of reduced cross section on a part of circumference of said shaft, in which said material passes without braking force, whereby rotation of said shaft results in a change of braking force on the material.

2. A device, according to claim 1, wherein axially on both sides of the window, said shaft has annular collars of circular cross section as supporting surfaces against which said plate resiliently abuts.

3. A device according to claim 1, wherein said motor comprises an electromagnetic rotary drive which is arranged fixed in position, and said shaft has a bearing-side end section forming a permanent magnet formed as a rotor which is rotated by said rotary drive.

4. A device according to claim 3, further comprising control means, and an electric coupling connecting said control means to said rotary drive.

5. A device according to claim 3, wherein said rotary drive cyclically drives said rotor, and thereby said shaft.

6. A device, according to claim 1, wherein said window is formed by said reduced cross section which extends over about 90° of the circumference of said shaft, and has a convexly shaped bottom with linear transition into the circumference of said shaft.

7. A device according to claim 1, wherein said window is formed by said reduced cross section forming an eccentric arrangement of a circular section of smaller diameter with respect to another part of said shaft.

8. A device according to claim 1, further comprising a friction bearing, a self-supporting mandrel secured by friction in said bearing, yet rotatably mounted in said friction bearing for adjustment, said plate extends from said mandrel, and means for rotating said mandrel in said bearing for regulating resilient abutment of said plate against said shaft.

* * * * *